US009086648B1

(12) United States Patent
Conrow et al.

(10) Patent No.: US 9,086,648 B1
(45) Date of Patent: Jul. 21, 2015

(54) CALIBRATING TONER CONCENTRATION SENSORS USING RELOAD MEASUREMENT

(71) Applicant: XEROX CORPORATION, Norwalk, CT (US)

(72) Inventors: Brian R. Conrow, Webster, NY (US); Douglas R. Taylor, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 5 days.

(21) Appl. No.: 14/183,793

(22) Filed: Feb. 19, 2014

(51) Int. Cl.
*G03G 15/10* (2006.01)
*G03G 15/08* (2006.01)

(52) U.S. Cl.
CPC ..... *G03G 15/0827* (2013.01)

(58) Field of Classification Search
CPC ..... G03G 15/0827; G03G 15/0824; G03G 15/0849; G03G 15/0855; G03G 15/0853; G03G 15/0851; G03G 15/0825; G03G 15/0829
USPC ..... 399/49, 58
See application file for complete search history.

(56) References Cited

U.S. PATENT DOCUMENTS

| | | | |
|---|---|---|---|
| 5,887,221 | A | 3/1999 | Grace |
| 5,937,227 | A | 8/1999 | Wong et al. |
| 6,580,882 | B2 | 6/2003 | Hirsch et al. |
| 6,941,084 | B2 | 9/2005 | Hamby et al. |
| 7,158,732 | B2 | 1/2007 | Mo et al. |
| 7,194,216 | B2 | 3/2007 | Borton et al. |
| 7,697,857 | B2 | 4/2010 | Gross et al. |
| 2006/0127110 | A1 | 6/2006 | Borton et al. |
| 2008/0118268 | A1 | 5/2008 | Scheuer et al. |

*Primary Examiner* — Walter L Lindsay, Jr.
*Assistant Examiner* — Ruth Labombard
(74) *Attorney, Agent, or Firm* — Gibb & Riley, LLC

(57) ABSTRACT

Devices and methods detect an amount of toner on a photoreceptor caused by a printing process, and calculate a reload signal using a processor. The reload signal shows the amount of toner being reloaded on a donor roll from a toner container to replace the toner being removed from the donor roll during the printing process (as detected by an optical sensor). Such devices and methods generate a toner concentration (TC) sensor response representing a concentration of toner particles within the toner/developer mixture using a TC sensor, calculate a calibration sensor relationship between the TC sensor response and the reload signal, using the processor, based on changes in the TC sensor response and the reload signal that occur while changing the toner concentration during the printing process, and calibrate the TC sensor based on differences between the calibration sensor relationship and a previously established model relationship using the processor.

20 Claims, 4 Drawing Sheets

CALIBRATING TONER CONCENTRATION SENSORS USING RELOAD MEASUREMENT

BACKGROUND

Systems and methods herein generally relate to printers and copiers or reproduction machines, and more particularly, concern utilizing the reload operation of a developer donor roll to calibrate sensors.

In modern electrostatic printers, a complex system is utilized to transfer the marking material from a container to an intermediate device, and then finally onto the print media. For ease of nomenclature, the term "toner" as used herein is intended to represent all forms of marking materials that are patterned or transferred using an electrical and/or static charge (whether currently known or developed in the future). Similarly, the term "print media" as used herein is intended to represent all forms of materials onto which markings may be transferred, including paper, transparencies, card stock, cardboard, metals, alloys, woods, ceramics, etc. (whether currently known or developed in the future).

Some electrostatic printing systems use a roller or magnetic brush to load toner onto a donor roll, which delivers the toner to the latent charge image on the photoreceptor. After the toner is stripped from the donor roll and delivered to the image, the donor roll reloads toner from the magnetic brush. In order to maintain consistent printing quality, various properties of the toner should be tightly controlled including the concentration of toner particles relative to carrier granules (or other similar development material) within the mixture of toner particles and carrier granules. This measure commonly referred to as "toner concentration" or TC.

Various devices are utilized to detect toner concentration including optical devices and electronic devices. In one example of an electronic device that detects toner concentration, a first voltage can be applied to a developer carrying member and a second voltage can be applied to a metering blade. The current between the developer carrying member and the metering blade is measured, generating a signal indicative thereof, and the toner concentration is calculated as a function of the generated signal. In another example, infrared densitometers (IRDs) can be used to measure toner concentration (TC) based on density.

In addition, there are several existing methods to calibrate TC sensors (empirically testing the TC sensors with a fresh package of toner/developer mixture, using a vacuum tool to remove a limited portion of the toner/developer mixture and independently empirically testing the toner/developer mixture, etc.) These methods can be time consuming and inaccurate. If the TC sensor is incorrectly calibrated, image quality defects can occur. If the TC is too low, reload can occur, and if the TC is too high, background, spitting and emissions can occur. The actual TC percentage is not as notable as avoiding the image quality defects that result when TC is simply too low or too high.

SUMMARY

An exemplary printing apparatus herein comprises a container maintaining a toner/developer mixture (comprising toner particles and carrier granules); and a toner concentration (TC) sensor operatively (meaning directly or indirectly) connected to the container. The TC sensor outputs a "TC sensor response" representing the concentration of toner particles within the toner/developer mixture. The printing apparatus further includes a donor roll receiving the toner from the container, a photoreceptor receiving the toner from the donor roll, and an exposure station adjacent the photoreceptor. Also, an optical sensor is positioned adjacent the photoreceptor, and a processor is operatively connected to the toner concentration sensor, the optical sensor, and the exposure station.

More specifically, the toner concentration sensor can be, for example, a light source positioned relative to the container to direct light at the toner/developer mixture, and a light sensor positioned relative to the container to detect the light as altered by the toner/developer mixture. Alternatively, the toner concentration sensor can be, for example, an electrical sensor (operating through, for example, a metering blade) that detects resistance of the toner/developer mixture. The optical sensor comprises, for example, a full width array of light sensors extending across a width of the photoreceptor.

The exposure station patterns an electrical charge on the photoreceptor in a printing process and the electrical charge is used to transfer patterns of toner from the donor roll to the photoreceptor. The full-width array's optical sensor detects the amount of toner that is on the photoreceptor as a result of the patterns of toner being transferred from the donor roll to the photoreceptor.

By measuring the amplitude of the differences in reflectance in a halftoned patch following a test pattern that would generate periodic, localized reload differences, the processor calculates a "reload signal" that represents the amount of toner being reloaded on the donor roll from the toner container to replace portions of the toner removed from the donor roll by the patterns of toner being transferred from the donor roll to the photoreceptor. The processor calculates this reload signal based on an FFT of the full-width reflectance profile of the halftone following the generating test pattern. This halftone can occur in "inter-document zones" of the photoreceptor. Such inter-document zones are located on the photoreceptor between "document zones" of the photoreceptor, where the document zones of the photoreceptor are the areas of the photoreceptor used to transfer the toner to sheets of print media. The measurement of the reload signal should not be assumed to be limited to measurements in the inter-document zones.

The processor calculates a "calibration sensor relationship" between the TC sensor response and the reload signal based on changes in the TC sensor response and the reload signal that occur while changing the toner concentration during the printing process. The processor then calibrates the TC sensor based on this calibration sensor relationship. One method to obtain the relationship between the reload signal and the TC sensor response is for the processor to modify or disable the automatic toner concentration replenishment system when calculating the TC sensor response to allow the toner concentration to fall at a predetermined rate. Another method is to continuously increase the TC target that the machine is controlling to while collecting the TC sensor and reload signals. In addition, the processor calibrates the TC sensor using the calculated calibration sensor relationship in combination with a previously established model relationship between the TC sensor response and the reload signal.

An exemplary method herein patterns an electrical charge on a photoreceptor using an exposure station in a printing process. The electrical charge is used to transfer patterns of a toner from a donor roll to the photoreceptor. This exemplary method also detects the amount of the toner on the photoreceptor caused by the patterns of toner transferred from the donor roll to the photoreceptor using an optical sensor.

Further, this exemplary method calculates a reload signal using a processor. The reload signal represents the amount of the toner that is reloaded on the donor roll from a toner container to replace portions of the toner removed from the donor roll when patterns of the toner are transferred from the donor roll to the photoreceptor during the printing process. The reload signal is based on the amount of the toner on the photoreceptor detected by the full-width array optical sensor in inter-document zones of the photoreceptor. These inter-document zones are between document zones of the photoreceptor that are used to transfer the toner to sheets of print media.

This exemplary method can then generate a TC sensor response that represents the concentration of toner particles within the toner/developer mixture (using a TC sensor). This method can modify or disable any automatic toner concentration replenishment systems when calculating the TC sensor response to allow the toner concentration to fall at a predetermined rate.

This exemplary method then calculates a calibration sensor relationship between the TC sensor response and the reload signal (using the processor) based on changes in the TC sensor response and the reload signal that occur while changing the toner concentration during the printing process. This exemplary method subsequently calibrates the TC sensor based on the TC sensor response known to cause the maximum allowable reload level and the actual TC sensor response when this level of reload is measured.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
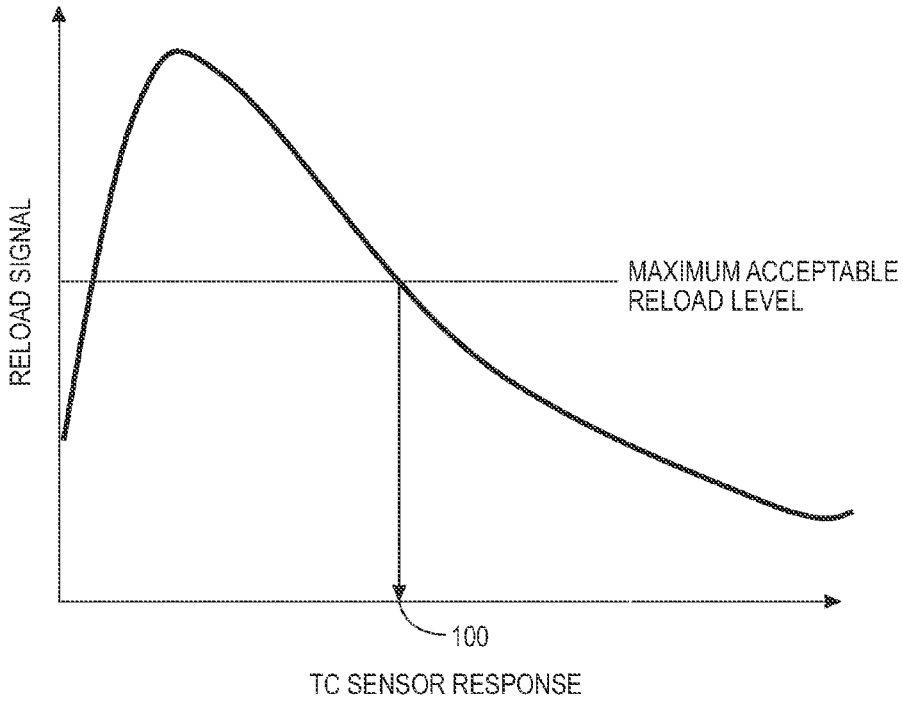
FIG. 1 is a graph illustrating operations of devices and methods herein.

As mentioned above, if the TC sensor is incorrectly calibrated, image quality defects can occur. In view of this, the devices and methods herein calibrate TC sensors based on the reload signal measured in a print engine. By measuring the reload signal as a function of the TC sensor response, the TC sensor can be calibrated based on the measured reload signal. The devices and methods herein can use a full width array sensor to measure the reload amplitude in inter-document zone patches while printing stress reload images in the image panels. These measurements are made in every inter-document zone while sweeping through a range of toner concentrations.

One exemplary procedure to calibrate TC using reload measured by an optical sensor can include the following steps.

1. Sweeping the printing machine through a range of TCs. This can be accomplished with open loop TC control to prevent the toner from being automatically replenished in the system.

2. Printing a stress reload pattern in the image panels. In one example, the stress reload pattern can include periodic vertical bars such that reload from these vertical bars falls in the inter-document zone location.

3. Printing full width halftone patches in the inter-document zone (for example, with 70% area coverage, or more or less coverage) to monitor reload amplitude in every inter-document zone throughout the TC sweep.

4. Obtaining one-dimensional cross-process profiles of the inter-document zone halftone patches.

5. Determining the amplitude of the reload by taking the fast fourier transform (FFT) of the one-dimensional cross-process profiles and obtaining the amplitude at the vertical bar frequency.

6. Determining the relationship between the measured reload amplitude and TC sensor response (uncalibrated).

7. Determining a new TC sensor calibration that maintains reload defects at an acceptable level.

The devices and methods herein reduce service costs on service calls where TC calibration is required, as current methods are time consuming and inaccurate. Further, for devices that cannot be calibrated with conventional methods, the devices and methods herein provide a useful alternative.

Therefore, the systems and methods herein provide devices and methods to calibrate the toner concentration (TC) sensors based on the reload signal measured in a print engine. By measuring the reload signal as a function of the TC sensor response, the TC sensor can be calibrated. The reload amplitude is measured on the photoreceptor belt using the inline full width array sensor. For example, a profile through uniform strips can be measured. Previous to these strips, a series of vertical strips can be printed which is a stress for reload. These measurements are made in an efficient way by starting at a high TC and monitoring both TC and the reload signal as the toner concentration is run down.

More specifically, as printing occurs some of the toner materials are consumed, and some of these materials are returned or replenished to the storage containers within the printing device to allow future printing to continue uninterrupted. For example, during printing, unused amounts of toner/developer mixture are scraped from drums and belts within the printer (and returned to be reused where possible). This, along with variation in the area coverage on each printed page, causes the concentration of toner material within the toner/developer mixture supply container to constantly change as the toner particles and developer material are used at different rates. Control systems within the printer automatically add toner particles and/or developer material into the toner/developer mixture container in order to replenish the various materials (as they are consumed during printing) in order to maintain the concentration of toner material at the appropriate levels.

During the calibration performed by devices and methods herein, such automatic systems that replenish the developer and toner materials can be modified or disabled. During printing operations, more toner is consumed relative to the amount of developer material that is lost, which naturally makes the toner concentration decrease as additional sheets are printed (with the automatic replenishment systems modified or disabled). During the calibration procedure, the devices and systems herein control the amount of toner particles and/or developer material added to the toner/developer mixture container to intentionally reduce or increase the toner concentration at a predetermined rate (per amount of printing).

As the toner concentration decreases, it becomes more difficult for the magnetic brush or roller to fully reload the donor roll with a sufficient amount of toner, which results in a "reload deficiency" on the donor roll. As the donor roll reload deficiency increases, less toner particles are transferred to the photoreceptor, and this results in test patches on the photoreceptor being lighter than they are expected to be (containing less toner than was intended). The devices and methods herein measure the density of the test patches on the photoreceptor using optical sensors (such as a full width array (FWA) of optical sensors).

Devices and methods herein calculate a known relationship between decrease in toner concentration and reload deficiency from historical empirical measurements and testing. For example, as part of the testing of new devices (or new subsystems) the ability to reload toner to the donor roll utilizing a specific toner concentration is developed empirically, and such previously established relationships are stored for future comparison. During such empirical testing, the actual toner concentration is determined by independently testing the toner/developer mixture, by using a toner/developer mixture with a known concentration, etc. By using equipment known to be operating properly (independently verified as being operational) and by using toner/developer mixture with a known concentration, the reloading that occurs during the empirical historical testing can be determined with high accuracy, thereby creating a predetermined model (standard) relationship by which the TC sensor's performance can be judged in the future.

Periodically, or when necessitated by printing errors, the sensors that detect toner concentration can be calibrated simply and easily by the devices and methods herein through a calibration printing operation that detects the test patches on the photoreceptor using optical sensors. As detailed above, the behavior of the automated systems that replenish toner and developer materials are temporarily modified and special calibration controls are used in their place to cause the toner concentration to sweep across a certain range. Printing operations that require large amounts toner in generating test pattern (60%, 70%, 80%, etc., halftone toner coverage) are utilized during such calibration operations to heavily stress the ability of the system to reload the donor roll. Then, any decrease in toner concentration seen on the photoreceptor (as detected by the optic sensors) caused by such intentional decreases in toner concentration and large amount of toner coverage demand, can be measured by the devices and methods herein and compared with the expected measurement for toner concentration that would be expected based on the previously known model relationships (developed using historical empirical measurements).

FIG. 1 represents the relationship between the TC sensor response and the measured reload signal. There is a known reload signal level that corresponds to an expected TC sensor reading. The actual TC sensor reading is compared with the expected reading at this point and the sensor is calibrated based on the difference. Item 100 in FIG. 1 illustrates the pre-defined TC level that produces the minimum acceptable reload level. The sensor is calibrated so that the TC response at point 100 corresponds to the predefined TC level.

Figure 2:
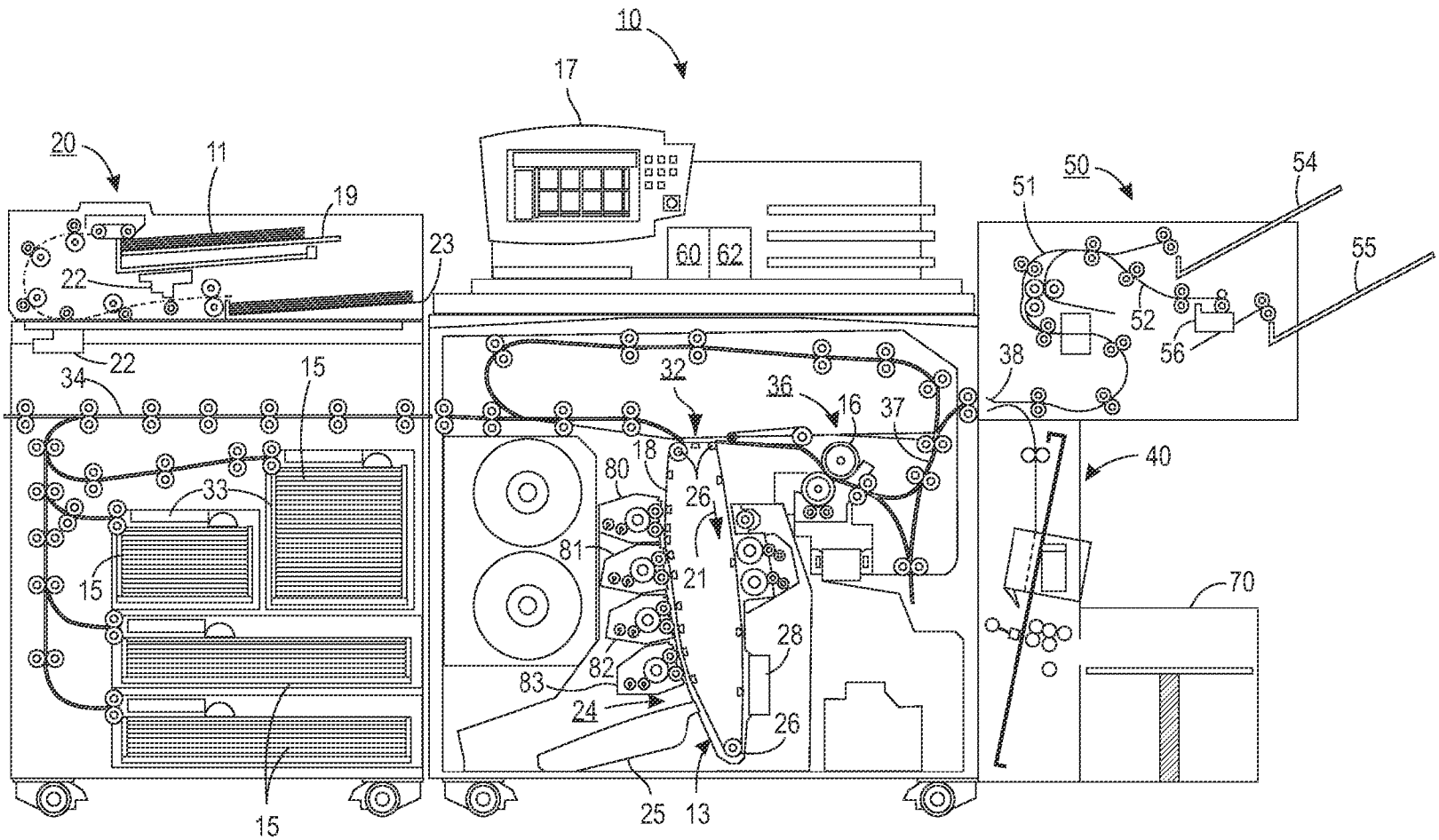
FIG. 2 is a schematic diagram illustrating devices herein.

Referring to the FIG. 2 a printing machine 10 is shown that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile tangible storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image (or, as explained below, item 18 in FIG. 2 could represent an intermediate transfer belt if photoreceptors are maintained in each development unit). The belt 18 here is mounted on a set of rollers 26. At least one of the rollers is driven to move the belt in the direction indicated by arrow 21 past the various other known electrostatic processing stations including a charging station 28, imaging station 24 (for a raster scan laser system 25), developing stations 80-83, and transfer station 32. Note that devices herein can include a single development station 80, or can include multiple development stations 80-83.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices, which contact and handle sheets within finisher module 50, are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling As would be understood by those ordinarily skilled in the art, the printing device 10 shown in FIG. 2 is only one example and the systems and methods herein are equally applicable to other types of printing devices that may include fewer components or more components. For example, while a limited number of printing engines and paper paths are illustrated in FIG. 2, those ordinarily skilled in the art would understand that many more paper paths and additional printing engines could be included within any printing device used with systems and methods herein.

Figure 3:
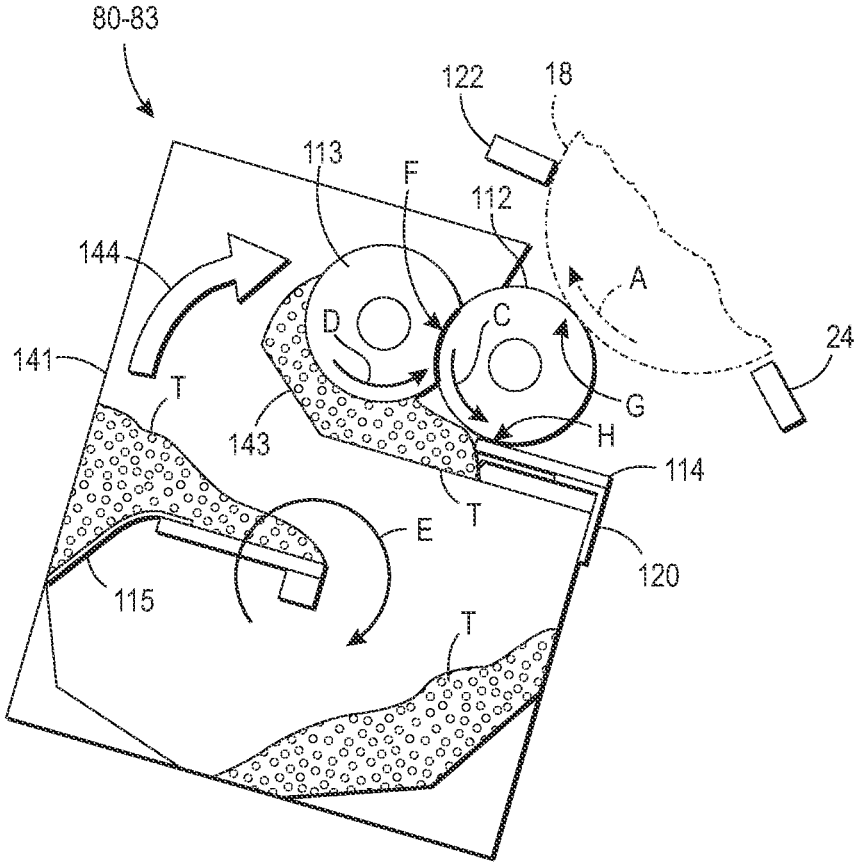
FIG. 3 is a schematic diagram illustrating devices herein.

FIG. 3 illustrates a cross-section of the development systems 80-83 shown in FIG. 2. In some examples herein a printing device can include a single development system, and others (such as the one illustrated in FIG. 2, discussed above) can include multiple development systems 80-83. Therefore, FIG. 3 is intended to illustrate a stand-alone development device and/or a development device used in combination with other development devices. As would be understood by those ordinarily skilled in the art, each individual development system 80-83 can include its own photoreceptor 18 and in such a situation, item 18 in FIG. 2 can represent an intermediate transfer belt (ITB). Alternatively, item 18 in FIG. 2 can represent a universal photoreceptor, as noted above.

As shown in FIG. 3, toner (T) is maintained in a container 114 (e.g., a cartridge sump). A paddle 115 that rotates as shown by arrow E, is used to load a supply roller 113 with toner T by moving toner particles to the supply roll area in a direction shown by arrow 144. As shown by arrow D, the supply roller or magnetic brush 113 rotates to load (or reload) the toner T to a donor roll 112 in a nip F created between the two rolls. In some embodiments, the orientation of the development system 80-83 may be upside down relative to that shown in FIG. 3, so that gravity is used to move toner particles to the supply roll area, instead of a paddle 115.

Items 114 represent a metering blade 114 that scrapes off excess toner T from the donor roll 112 to meter (control) the amount of toner T that remains on the donor roll 112 as the surface of the donor roll 112 moves toward the photoreceptor 18. Thus, as the donor roll 112 rotates as shown by arrow C, the toner T is metered in the nip H of the metering blade 114 that is held in contact against the donor roll 112 with a predetermined force. After the surface of the donor roll 112 moves past the metering blade 114, enough toner T is brought into the development zone G (at the nip G where the donor roll 112 contacts the photoreceptor 18) to support acceptable solid area and halftone uniformity on the latent image on the photoreceptor 18.

Thus, an exemplary printing apparatus 10 herein comprises a container 141 maintaining a toner/developer mixture T (comprising toner particles and carrier granules); and a toner concentration (TC) sensor 120 operatively (meaning directly or indirectly) connected to the container 141. The TC sensor 120 outputs a "TC sensor response" representing the concentration of toner particles within the toner/developer mixture T. The printing apparatus 10 further includes a donor roll 112 receiving the toner T from the container 141 (as detailed above), a photoreceptor 18 receiving the toner T from the donor roll 112, and an exposure station adjacent the photoreceptor 18. Also, an optical sensor 122 is positioned adjacent the photoreceptor 18, and a processor 60 is operatively connected to the toner concentration sensor, the optical sensor 122, and the exposure station.

More specifically, the toner concentration sensor 120 can be, for example, a light source positioned relative to the container 141 to direct light at the toner/developer mixture T, and a light sensor positioned relative to the container 141 to detect the light as altered by the toner/developer mixture T. Alternatively, the toner concentration sensor 120 can be, for example, an electrical sensor (operating through, for example, the metering blade) that detects resistance of the toner/developer mixture T. The optical sensor 122 comprises, for example, a full width array of light sensors extending across a width of the photoreceptor 18.

The exposure station 24 patterns an electrical charge on the photoreceptor 18 in a printing process and the electrical charge is used to transfer patterns of toner T from the donor roll 112 to the photoreceptor 18. The optical sensor 122 detects the amount of toner T that is on the photoreceptor 18 as a result of the patterns of toner T being transferred from the donor roll 112 to the photoreceptor 18.

By measuring the amplitude of the differences in reflectance in a halftoned patch following a test pattern that would generate periodic, localized reload differences, the processor 60 calculates a "reload signal" that represents the amount of toner T being reloaded on the donor roll 112 from the toner container 141 to replace portions of the toner T removed from the donor roll 112 by the patterns of toner T being transferred from the donor roll 112 to the photoreceptor 18. The processor 60 calculates this reload signal based on the amount of the toner T on an FFT of the full-width reflectance profile of the halftone following the generating test pattern. This halftone can occur in "inter-document zones" of the photoreceptor 18. Such inter-document zones are located on the photoreceptor 18 between "document zones" of the photoreceptor 18, where the document zones of the photoreceptor 18 are the areas of the photoreceptor 18 used to transfer the toner T to sheets of print media. The measurement of the reload signal should not be assumed to be limited to measurements in the inter-document zones.

The processor 60 calculates a "calibration sensor relationship" between the TC sensor response and the reload signal based on changes in the TC sensor response and the reload signal that occur while changing the toner concentration during the printing process. The processor 60 then calibrates the TC sensor 120 based on this calibration sensor relationship. One method to obtain the relationship between the reload signal and the TC sensor response is for the processor 60 to modify or disable the automatic toner concentration replenishment systems when calculating the TC sensor response to allow the toner concentration to fall at a predetermined rate. Another method is to continuously increase the TC target that the machine is controlling to while collecting the TC sensor and reload signals. In addition, the processor 60 calibrates the TC sensor 120 using the calculated calibration sensor relationship in combination with a previously established model relationship between the TC sensor response and the reload signal.

Figure 4:
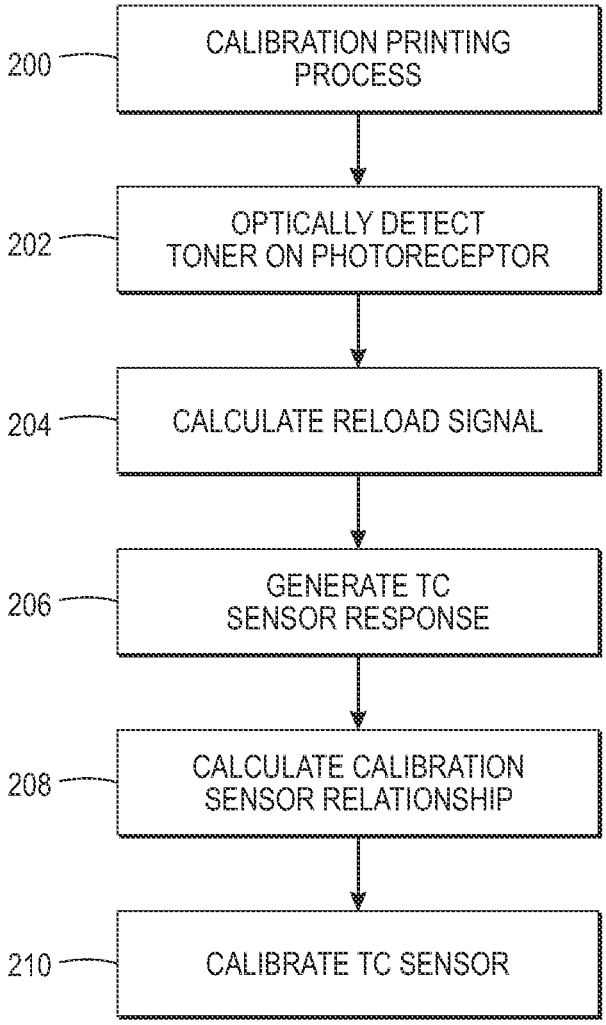
FIG. 4 is a flow diagram illustrating various methods herein.

FIG. 4 is flowchart illustrating exemplary methods herein. These methods pattern an electrical charge on a photoreceptor using an exposure station and transfer toner to the photoreceptor in a calibration printing process (item 200). The electrical charge is used to transfer patterns of a toner from a donor roll to the photoreceptor in item 200. In item 202, these exemplary methods also detect the amount of the toner on the photoreceptor caused by the patterns of toner transferred from the donor roll to the photoreceptor using an optical sensor.

As shown in item 204, these exemplary methods calculate a reload signal using a processor. The reload signal is calculated in item 204 based on the amount of toner that is reloaded on the donor roll from a toner container to replace portions of the toner removed from the donor roll when patterns of the toner are transferred from the donor roll to the photoreceptor during the printing process. The reload signal calculated in item 204 can be based on the amount of the toner on the photoreceptor detected by the optical sensor in inter-document zones of the photoreceptor. These inter-document zones are between document zones of the photoreceptor that are used to transfer the toner to sheets of print media.

These exemplary methods can then generate a TC sensor response (e.g., TC sensor output or detection) in item 206 that represents the concentration of toner particles within the toner/developer mixture (using a TC sensor). These methods modify or disable any automatic toner concentration replenishment systems when calculating the TC sensor response to allow the toner concentration to fall at a predetermined rate.

In item 208, these methods then calculate a calibration sensor relationship between the TC sensor response and the reload signal (using the processor) based on changes in the TC sensor response and the reload signal that occur while changing the toner concentration during the printing process.

These exemplary methods subsequently calibrate the TC sensor in item 210 based on the TC sensor response known to cause the maximum allowable reload level and the actual TC sensor response when this level of reload is measured.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, processors, etc.) are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A printing apparatus comprising:

a container maintaining a toner/developer mixture;

a toner concentration sensor operatively connected to said container, said toner concentration sensor outputting a toner concentration sensor response representing a concentration of toner particles within said toner/developer mixture;

a donor roll receiving said toner particles from said container;

a photoreceptor receiving said toner particles from said donor roll;

an optical sensor positioned adjacent said photoreceptor, said optical sensor detecting an amount of said toner particles on said photoreceptor; and a processor operatively connected to said toner concentration sensor and said optical sensor, said processor generating a reload signal comprising an amount of said toner particles being reloaded on said donor roll from said container to replace portions of said toner particles removed from said donor roll in a printing process, said processor calculating said reload signal based on said amount of said toner particles on said photoreceptor detected by said optical sensor, said processor calculating a calibration sensor relationship between said toner concentration sensor response and said reload signal based on changes in said toner concentration sensor response and said reload signal that occur while changing said toner concentration during said printing process, and said processor calibrating said toner concentration sensor based on differences between said calibration sensor relationship and a previously established model relationship.

2. The printing apparatus according to claim 1, said processor modifying automatic toner concentration replenishment systems during said calculating said toner concentration sensor response.

3. The printing apparatus according to claim 1, said previously established model relationship being between said toner concentration sensor response and said reload signal established during empirical testing.

4. The printing apparatus according to claim 1, said toner concentration sensor comprising one of:

a light source positioned relative to said container to direct light at said toner/developer mixture, and a light sensor positioned relative to said container to detect said light as altered by said toner/developer mixture;

an electrical sensor detecting resistance of said toner/developer mixture; and a permeability sensor detecting the inductance of said toner/developer mixture.

5. The printing apparatus according to claim 1, said optical sensor comprising a full width array, and said full width array comprising an array of light sensors extending across a width of said photoreceptor.

6. A printing apparatus comprising:

a container maintaining a toner/developer mixture comprising toner particles and carrier granules;

a toner concentration sensor operatively connected to said container, said toner concentration sensor outputting a toner concentration sensor response representing a concentration of toner particles within said toner/developer mixture;

a donor roll receiving said toner particles from said container;

a photoreceptor receiving said toner particles from said donor roll;

an exposure station adjacent said photoreceptor, said exposure station patterning an electrical charge on said photoreceptor in a printing process, said electrical charge being used to transfer reload-generating patterns of said toner particles from said donor roll to said photoreceptor;

an optical sensor positioned adjacent said photoreceptor, said optical sensor detecting an amount of said toner particles on said photoreceptor caused by said reload-generating patterns of said toner particles being transferred from said donor roll to said photoreceptor; and a processor operatively connected to said toner concentration sensor, said optical sensor, and said exposure station, said processor calculating a reload signal comprising an amount of said toner particles being reloaded on said donor roll from said container to replace portions of said toner particles removed from said donor roll caused by said reload-generating patterns of said toner particles being transferred from said donor roll to said photoreceptor, said processor calculating a calibration sensor relationship between said toner concentration sensor response and said reload signal based on changes in said toner concentration sensor response and said reload signal that occur while changing said toner concentration during said printing process, and said processor calibrating said toner concentration sensor based on differences between said calibration sensor relationship and a previously established model relationship.

7. The printing apparatus according to claim 6, said processor modifying automatic toner concentration replenishment systems during said calculating said toner concentration sensor response.

8. The printing apparatus according to claim 6, said previously established model relationship being between said toner concentration sensor response and said reload signal established during empirical testing.

9. The printing apparatus according to claim 6, said toner concentration sensor comprising one of:

a light source positioned relative to said container to direct light at said toner/developer mixture, and a light sensor positioned relative to said container to detect said light as altered by said toner/developer mixture;

an electrical sensor detecting resistance of said toner/developer mixture; and a permeability sensor detecting the inductance of said toner/developer mixture.

10. The printing apparatus according to claim 6, said optical sensor comprising a full width array, and said full width array comprising an array of light sensors extending across a width of said photoreceptor.

11. A method comprising:

detecting an amount of toner particles on a photoreceptor caused by a printing process;

calculating a reload signal using a processor, said reload signal comprising an amount of said toner particles being reloaded on a donor roll from a container to replace portions of said toner particles removed from said donor roll caused by said printing process, said reload signal being based on said amount of said toner particles on said photoreceptor detected by an optical sensor;

generating a toner concentration sensor response representing a concentration of said toner particles within a toner/developer mixture using a toner concentration sensor;

calculating a calibration sensor relationship between said toner concentration sensor response and said reload signal using said processor based on changes in said toner concentration sensor response and said reload signal that occur while changing said toner concentration during said printing process; and calibrating said toner concentration sensor based on differences between said calibration sensor relationship and a previously established model relationship using said processor.

12. The method according to claim 11, further comprising disabling automatic toner concentration replenishment systems during said calculating said toner concentration sensor response.

13. The method according to claim 11, further comprising calculating said previously established model relationship between said toner concentration sensor response and said reload signal during empirical testing.

14. The method according to claim 11, said toner concentration sensor comprising one of:

a light source positioned relative to said container to direct light at said toner/developer mixture, and a light sensor positioned relative to said container to detect said light as altered by said toner/developer mixture;

an electrical sensor detecting resistance of said toner/developer mixture; and a permeability sensor detecting the inductance of said toner/developer mixture.

15. The method according to claim 11, said optical sensor comprising a full width array, and said full width array comprising an array of light sensors extending across a width of said photoreceptor.

16. A method comprising:

patterning an electrical charge on a photoreceptor using an exposure station in a printing process, said electrical charge being used to transfer reload-generating patterns of a toner particles from a donor roll to said photoreceptor;

detecting an amount of said toner particles on said photoreceptor caused by said reload-generating patterns of said toner particles being transferred from said donor roll to said photoreceptor using an optical sensor;

calculating a reload signal using a processor, said reload signal comprising an amount of said toner particles being reloaded on said donor roll from a container to replace portions of said toner particles removed from said donor roll caused by said reload-generating patterns of said toner particles being transferred from said donor roll to said photoreceptor, said reload signal being based on said amount of said toner particles on said photoreceptor detected by said optical sensor in inter-document zones of said photoreceptor, said inter-document zones being between document zones of said photoreceptor used to transfer said toner particles to sheets of print media;

generating a toner concentration sensor response representing a concentration of said toner particles within a toner/developer mixture using a toner concentration sensor, said toner/developer mixture comprising said toner particles and carrier granules;

calculating a calibration sensor relationship between said toner concentration sensor response and said reload signal using said processor based on changes in said toner concentration sensor response and said reload signal that occur while changing said toner concentration during said printing process; and calibrating said toner concentration sensor based on differences between said calibration sensor relationship and a previously established model relationship using said processor.

17. The method according to claim 16, further comprising disabling automatic toner concentration replenishment systems during said calculating said toner concentration sensor response.

18. The method according to claim 16, further comprising calculating said previously established model relationship between said toner concentration sensor response and said reload signal during empirical testing.

19. The method according to claim 16, said toner concentration sensor comprising one of:

a light source positioned relative to said container to direct light at said toner/developer mixture, and a light sensor positioned relative to said container to detect said light as altered by said toner/developer mixture;

an electrical sensor detecting resistance of said toner/developer mixture; and a permeability sensor detecting the inductance of said toner/developer mixture.

20. The method according to claim 16, said optical sensor comprising a full width array, and said full width array comprising an array of light sensors extending across a width of said photoreceptor.

* * * * *